United States Patent [19]

Nawa et al.

[11] 4,424,937

[45] Jan. 10, 1984

[54] FLUID DEFLECTING ASSEMBLY

[75] Inventors: Motoyuki Nawa; Yutaka Takahashi, both of Nara; Masaru Nishijo, Tenri, all of Japan

[73] Assignee: Matsushita Electric Industrial Co., Ltd., Kadoma, Japan

[21] Appl. No.: 179,556

[22] Filed: Aug. 19, 1980

Related U.S. Application Data

[63] Continuation of Ser. No. 902,818, May 4, 1978, abandoned.

[30] Foreign Application Priority Data

May 7, 1977 [JP] Japan ..... 52-52276

[51] Int. Cl.[3] ..... B05B 1/04

[52] U.S. Cl. ..... 239/590; 239/592; 239/597

[58] Field of Search ..... 239/589, 590, 590.5, 239/592, 597, 265.19; 98/40 D, 40 V, 40 VM, 40 N, 41 R; 137/829-831, 875

[56] References Cited

U.S. PATENT DOCUMENTS

| | | | |
|---|---|---|---|
| 3,020,714 | 2/1962 | Eggers et al. | 239/265.19 |
| 3,102,389 | 9/1963 | Pedersen et al. | 60/35.54 |
| 4,146,357 | 3/1979 | Ward et al. | 239/DIG. 7 X |

FOREIGN PATENT DOCUMENTS

| | | | |
|---|---|---|---|
| 493728 | 6/1953 | Canada | 239/DIG. 7 |
| 1162605 | 8/1969 | United Kingdom | 98/40 V |

*Primary Examiner*—John J. Love

*Attorney, Agent, or Firm*—Wenderoth, Lind & Ponack

[57] ABSTRACT

A fluid deflecting assembly for deflecting a fluid medium in any desired direction, particularly suited for use in an air conditioner, which has a nozzle for issuing a main stream of fluid as the fluid passes therethrough, a guide wall at a position downstream of the nozzle and having substantially a diverging shape in a direction downstream with respect to the direction of flow of the main stream and opening outwardly in a direction away from the nozzle, and a control device for controlling the mode of flow of the fluid at a position upstream of the nozzle. The nozzle has a relatively small thickness in the direction of flow of the fluid therethrough and is so shaped as to constrict the flow of the fluid as the latter passes therethrough.

1 Claim, 17 Drawing Figures

FLUID DEFLECTING ASSEMBLY

The present application is a continuation of Ser. No. 902,818, filed May 4, 1978 now abandoned.

The present invention generally relates to a fluid deflecting assembly and, more particularly, to a fluid deflecting assembly of a construction capable of diverting a fluid medium in any desired direction at a relatively wide angle of deflection.

The fluid medium with which the fluid deflecting assembly according to the present invention operates includes either gas or liquid. However, the fluid deflecting assembly according to the present invention is particularly, though not limited thereto, applicable to an air conditioner which is required to have a construction wherein a stream of air, either hot or cool, is required to flow at a relatively wide angle of deflection towards a space in such a manner as to flow in any desired direction if necessary. In this application, the fluid deflecting assembly according to the present invention may either be installed at an exit opening or grill of the air conditioner, through which the stream of air emerges towards the space to be air-conditioned, or constitute a part of the exit arrangement of the air conditioner.

Other applications of the present invention include a water sprinkler and a fluid logic element utilizing either gas or liquid, as will readily be understood by those skilled in the art from the description of the present invention.

The fluid deflecting assembly according to the present invention itself is not a recent development and fluid deflecting assemblies of a construction such as shown in FIGS. 1 and 2, respectively, of the accompanying drawings are known.

Referring first to FIG. 1, one conventional fluid deflecting assembly is schematically shown in horizontal sectional view and has a construction having a supply nozzle 2, defined by a pair of parallel walls 1*a* and 1*b* spaced a distance Ws from each other, a pair of curved walls 7 and 8 located at a position downstream of the direction of flow of a stream of air and so shaped as to outwardly diverge from each other in a direction downstream of the direction of flow of the air stream, and a pair of opposed control chambers 3 and 4 positioned downstream of said nozzle 2 and upstream of the curved walls 7 and 8 and on respective sides of an air passage defined between the walls 1*a*, 7 and 1*b*, 8. The control chambers 3 and 4 are respectively communicated to the atmosphere through control apertures 5 and 6 each adapted to be selectively closed and opened in any desired or required manner.

Assuming that one opening of the supply nozzle 2 remote from the control chambers 3 and 4 is connected to a source of air (not shown) and the air enters the supply nozzle 2 while both of the control apertures 5 and 6 are opened, the stream of air issued from the supply nozzle 2 is caused to flow in a direction in alignment with a center axis X—X about which the deflecting assembly is in a symmetrical arrangement. However, in this case, since the flow of the air stream is not stabilized, the air stream issued from the supply nozzle 2 tends to deflect towards the curved wall 7 or 8.

However, subsequent closure of one of the control apertures, for example, the control aperture 6 results in development of a pressure differential between the control chambers 3 and 4, i.e., a negative pressure within the control chamber 4, and the air stream issued from the supply nozzle 2 is consequently drawn in a direction so as to flow along the curved wall 8 while adhering to the surface of the curved wall 8 as shown by arrows B. The phenomenon in which the deflection of flow of the air stream upon closure of one of the control apertures 5 and 6 is achieved is a self-compensating one.

It is to be noted that, during the flow of the air stream between the parallel walls 1*a* and 1*b* in the manner as hereinbefore described, the air stream flowing through the nozzle 2 receives no deflection and, therefore, a vector component of the flow of the air stream flowing through the nozzle 2 is in parallel relation to the center axis X—X as shown by the arrow A.

In the conventional fluid deflecting assembly of the construction shown in FIG. 1, where the air stream is desired to be deflected at a relatively wide angle, such as shown by O2, relative to the center axis X—X, the curved wall 8 to which the air stream adheres incident to the closure of the control aperture 6 must be curved to have a relatively great angle of arch while the length L of the fluid deflecting assembly as measured from the point at which the air stream emerges outwardly from the supply nozzle 2 to the point lying in a plane parallel to the opening defined between free ends of the walls 7 and 8 remote from the associated control chambers 3 and 4, has to be five to six times the width Ws of the nozzle 2. In addition, since the deflection of the air stream is based on the self-compensating phenomenon as hereinbefore described, deflection of the direction of flow of the air stream in any desired direction involves difficulty. Moreover, once the angle of deflection of flow of the air stream has been fixed, it cannot be selected at will.

Referring now to FIG. 2 wherein another conventional fluid deflecting assembly is shown schematically in a view similar to FIG. 1, the deflecting assembly shown in FIG. 2 comprises a solid block 9 having a supply passage 10 having an upstream end, opening at one end face of the block 9 and adapted to be connected to a source of air (not shown), and a downstream end constricted by a pair of opposed protrusions 21 and 22 to provide an orifice between the tips of the respective protrusions 21 and 22, and a pair of flow passages 11 and 12 diverging outwardly from each other in a substantially V-shaped configuration. On respective sides of a passage for the flow of the air stream from the orifice towards the point of divergence of the flow passages 11 and 12, there are formed respective vortex chambers 13 and 14 so shaped as to diverge outwardly from each other from the orifice and then to inwardly converge towards the orifice, the boundary between the point of divergence of the flow passages 11 and 12 and the vortex chambers 13 and 14 being defined by respective apex portions 15 and 16. These vortex chambers 13 and 14 are communicated respectively to control air passages 19 and 20 having associated valves 17 and 18 disposed therein.

In the conventional deflecting assembly having the construction shown in FIG. 2, assuming that both of the valves 17 and 18 are closed with no control air supplied into the vortex chambers 13 and 14 while the air is supplied into the supply passage 10, a stream of air passing through the passage between the vortex chambers 13 and 14 flows towards one of the flow passages 11 and 12 which is substantially opposed to the vortex chamber where pressure reduction takes place for any reason. Closure of one of the valves, for example, the valve 17 while the valve 18 remains opened, causes a portion of the air stream emerging from the orifice to form a vortex flow within the vortex chamber 13 as enhanced by the protrusion 21 and the pressure within the vortex chamber 13 becomes lower than that within the vortex chamber 14, thereby providing a pressure differential between the vortex chambers 13 and 14. Consequently, under the influence of this pressure differential, the air stream is oriented towards the flow passage 11.

The reverse takes place when the valve 18 is closed while the valve 17 is opened, with the air stream flowing towards the flow passage 12.

The function of the deflecting assembly having the construction shown in FIG. 2 may be called a flip-flop function since it substantially resembles to that of an electrical element known as a flip-flop.

It is to be noted that, in the deflecting assembly of the construction shown in FIG. 2, the deflection of flow of the air stream is controlled by the vortex flow occurring in either one of the vortex chambers 13 and 14 without relying on the known Coanda effect. Accordingly, a relatively wide angle of deflection of flow of the air stream cannot be achieved in a relatively short distance through which the air stream flows. Furthermore, since the fluid deflecting assembly of the construction shown in FIG. 2 is intended to provide a flip-flop function, the air stream can be switched over only between the two passages 11 and 12. If any arrangement is made to give the deflecting assembly of the construction of FIG. 2 the capability of diverting the air stream in any desired direction, the angle of deflection of flow of the air stream is limited to a relatively small value.

Apart from the deflecting assemblies heretofore known to those skilled in the art, the use of a louver constituted by a plurality of blade elements installed at the exit of an air-conditioner is well known. The louver is generally so designed as to allow a stream of air to be deflected after it has impinged upon the blades. However, the impingement of the air stream upon the blades used in deflecting the air stream cannot provide a relatively wide angle of deflection.

Other prior art deflecting assemblies are disclosed in U.S. Pat. Nos. 3,425,431, patented on Feb. 4, 1969; 3,524,461, patented on Aug. 18, 1970; and 3,680,776, patented on Aug. 1, 1972, British Patent Specification No. 1,372,734, published on Nov. 6, 1974, and "Fourth Granfied Fluidics Conference, Mar. 17th–20th 1970. Coventry (Paper A4)" entitled "A New Type of Fluidic Diverting Valve". However, it is believed that none of the above listed prior art references in any way suggests the construction and effect of the deflecting assembly herein disclosed for the purpose of the present invention.

In view of the foregoing, the present invention has been developed to provide an improved fluid deflecting assembly which involves hardly any of the disadvantages and inconveniences inherent in the prior art deflecting assembly.

Another object of the present invention is to provide an improved deflecting assembly of the type referred to above, which is capable of diverting a fluid medium in any desired direction while having a relatively short length of the fluid stream passage from the nozzle to the exit opening.

A further object of the present invention is to provide an improved deflecting assembly of the type referred to above, which is provided with an auxiliary deflector for forcibly deflecting the direction of flow of the fluid stream as the latter pass therethrough so that a relatively wide angle of deflection can be attained.

A still further object of the present invention is to provide an improved deflecting assembly of the type referred red to above, wherein control apertures are respectively defined in curved side walls, which outwardly diverge from each other at a position downstream of the nozzle with respect to the direction of flow of the fluid stream, any one of these control apertures being adapted to be selectively closed and opened to control the direction of flow of the fluid stream at a relatively wide angle of deflection.

According to the present invention herein disclosed, the improved deflecting assembly generally comprises a nozzle through which a fluid medium, for example, air, flows in one direction, a primary control chamber defined upstream of the nozzle with respect to the direction of flow of the air stream, and a pair of side walls so curved so as to outwardly diverge from each other, the area of the smallest spacing between the side walls being positioned adjacent the nozzle while the area of the largest spacing between the side walls is positioned remote from the nozzle to provide an exit opening of a substantially ribbon-like configuration.

The primary control chamber can have a width, as measured in a direction across the direction of flow of air towards the nozzle, greater than the width of the nozzle, and the improved deflecting assembly according to the present invention can further comprise means for developing a pressure differential between an area of the primary control chamber on one side of the fluid stream flowing through such control chamber and the opposite area of the primary control chamber on the other side of the same fluid stream.

The primary control chamber may have an auxiliary deflector, preferably in the form of a substantially rectangular blade extending in a direction parallel to the lengthwise direction of the nozzle, for forcibly deflecting the air stream passing through the nozzle.

These and other objects and features of the present invention will become apparent from the following description taken in conjunction with preferred embodiments thereof with reference to the accompanying drawings, in which.

Figure 3:
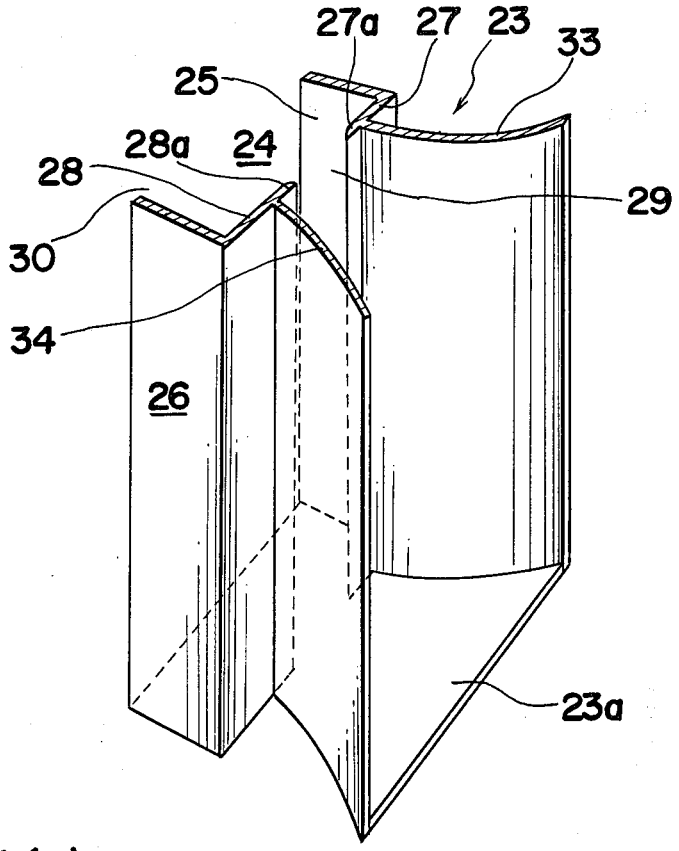
FIG. 3 is a perspective view, with a portion broken away, showing a basic structural body of the deflecting assembly which is employed in the preferred embodiments of the present invention.
Figure 4:
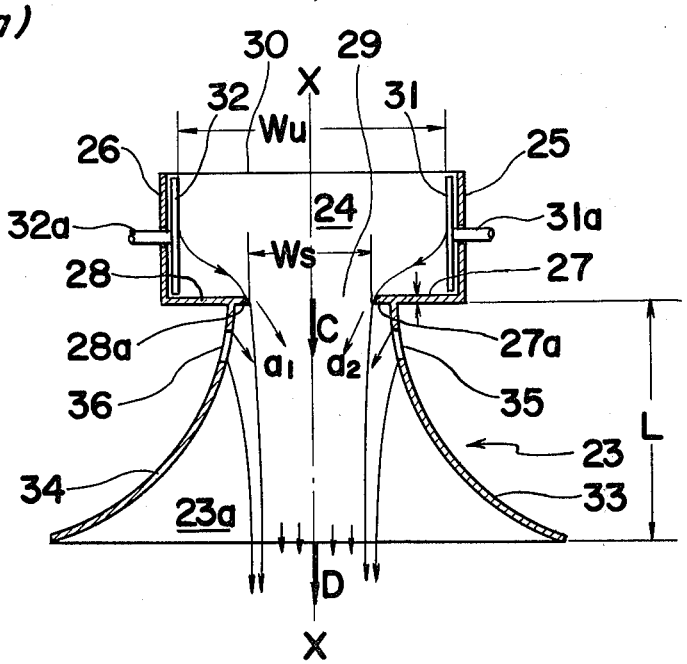
Figure 4B:
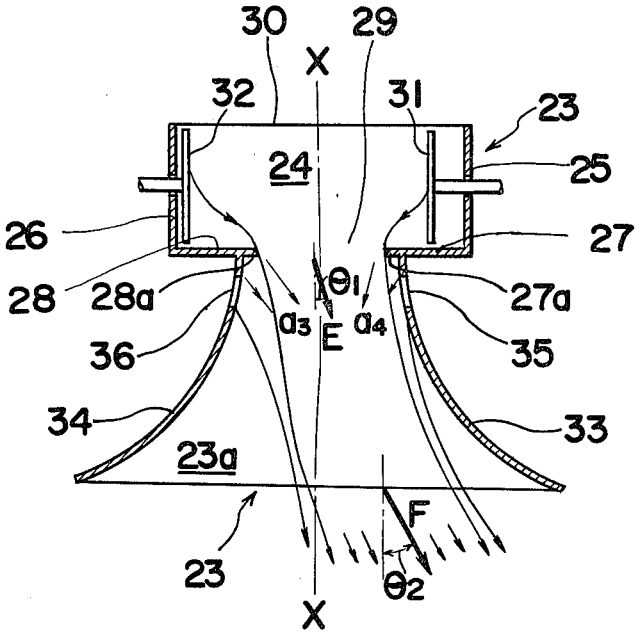
Figure 4C:
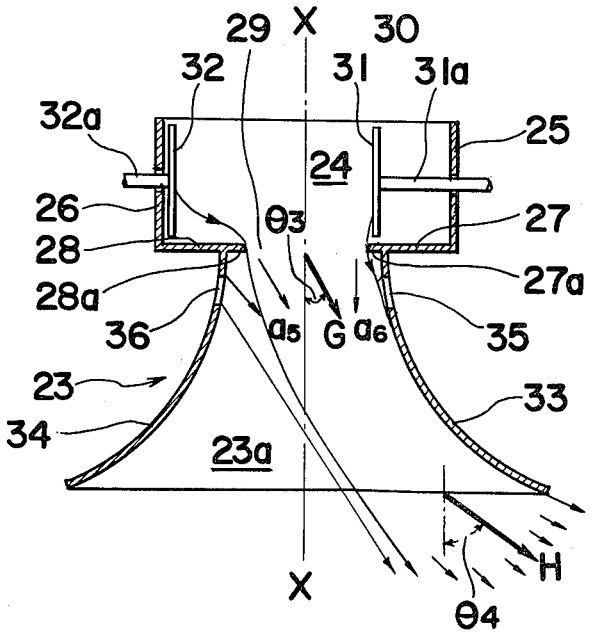
Figure 5:
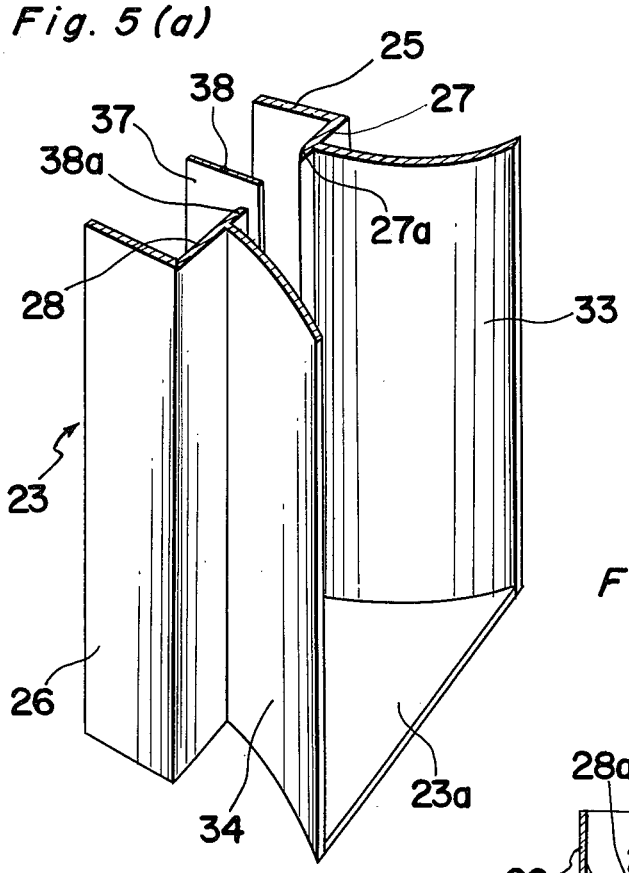
Figure 5:
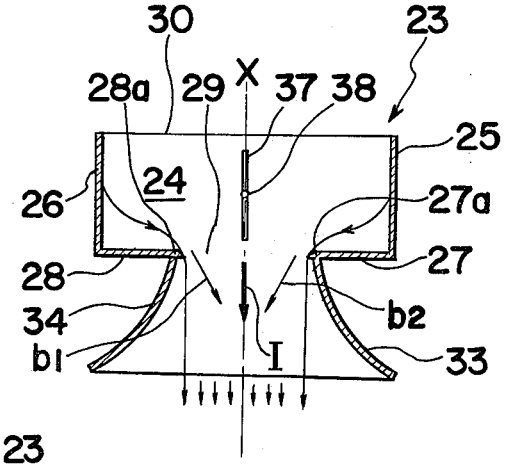
Figure 5:
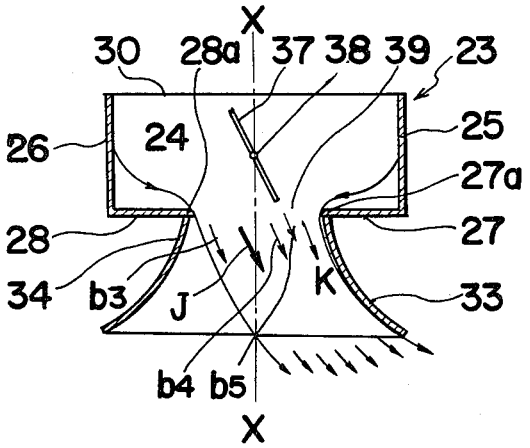
Figure 6A:
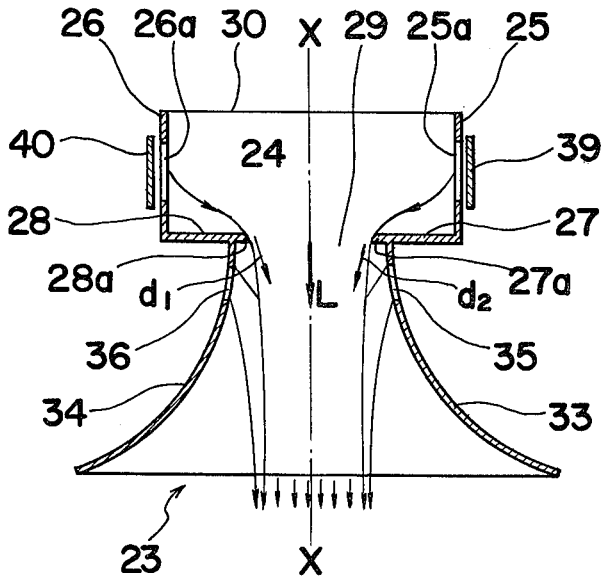
Figure 6B:
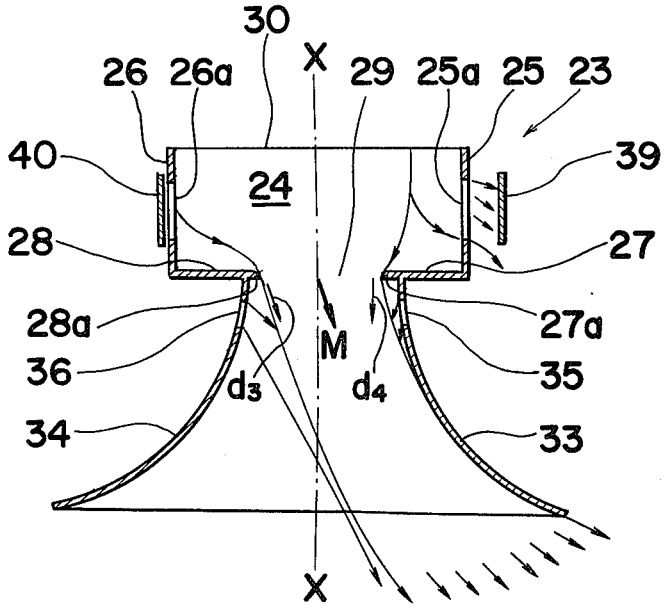
Figure 7:
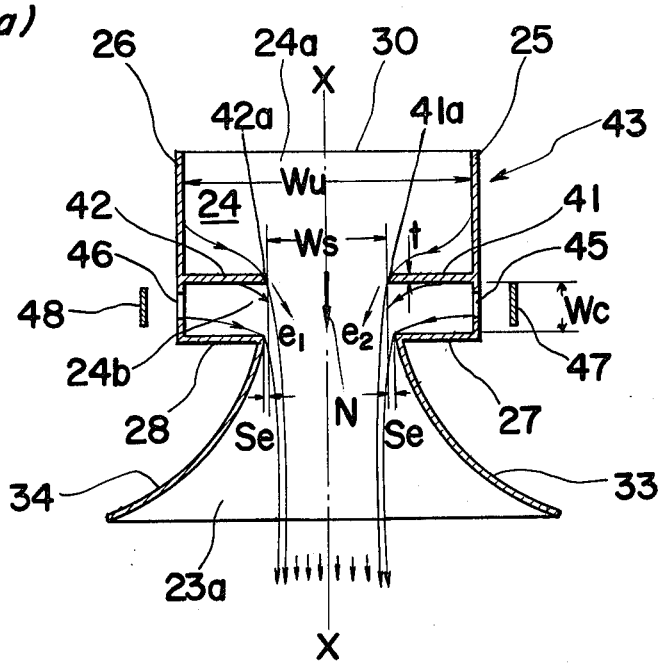
Figure 7:
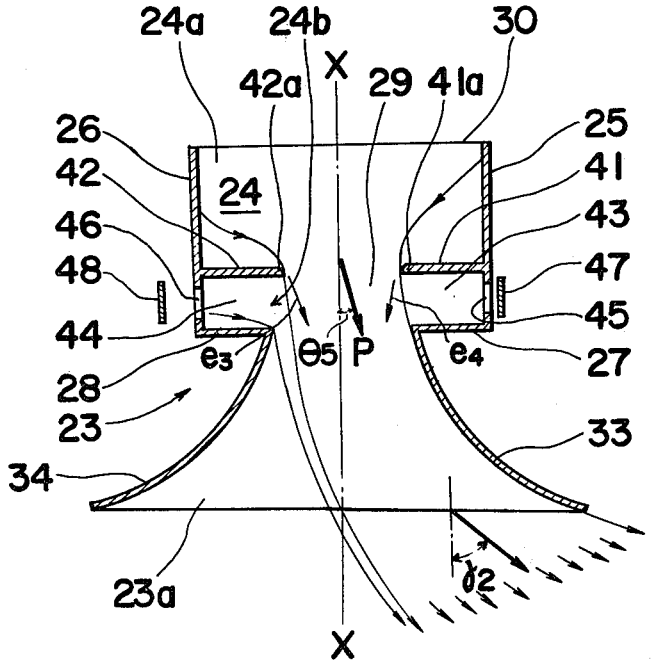
Figure 8A:
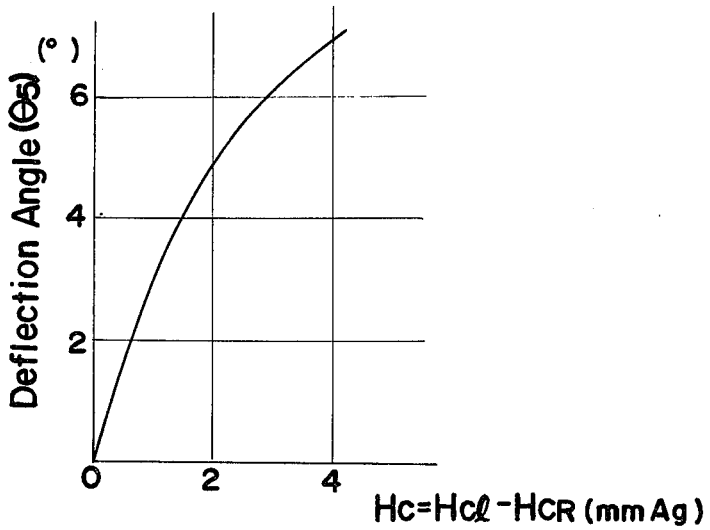
Figure 8B:
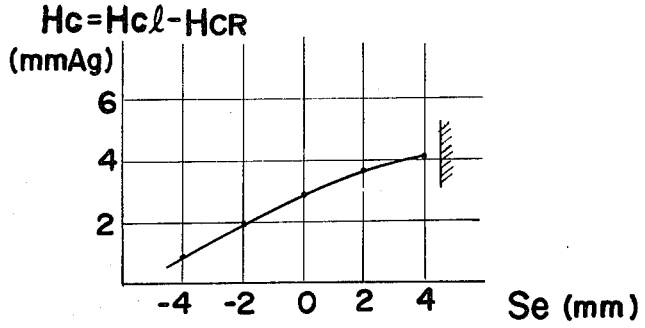
Figure 8C:
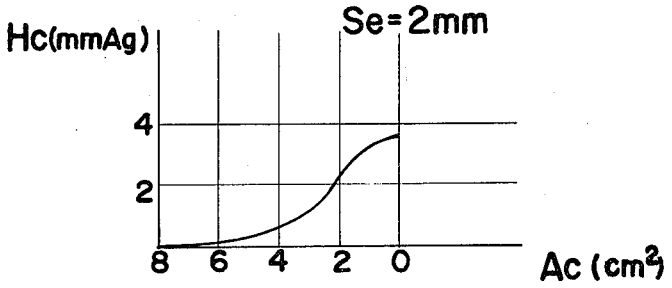
Figure 8D:
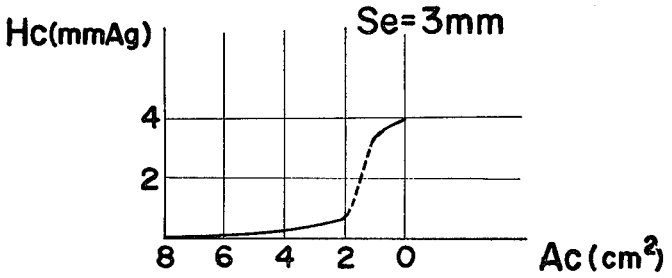

FIGS. 4*a*–4*c* illustrate a preferred embodiment of the present invention, being schematic sectional views of the deflecting assembly shown in different operative positions;

FIGS. 5*a*–5*c* illustrate another preferred embodiment of the present invention, FIG. 5(*a*) being a view similar to FIG. 3 showing the structural body with an auxiliary deflector built therein, and FIGS. 5(*b*) and 5(*c*) being schematic sectional views of the deflecting assembly shown in different operative positions;

FIGS. 6*a* and 6*b* illustrate a further preferred embodiment of the present invention, being schematic sectional views of the deflecting assembly shown in different operative positions;

FIGS. 7*a* and 7*b* illustrate a still further preferred embodiment of the present invention, being schematic sectional views of the deflecting assembly shown in different operative positions;

FIGS. 8*a*–8*d* illustrate characteristic curves of the deflecting assembly according to the embodiment shown in FIG. 7, FIG. 8(*a*) being a graph showing a characteristic curve of pressure differential versus deflection angle, FIG. 8(*b*) being a graph showing a characteristic curve of setback amount versus pressure differential, and FIGS. 8(*c*) and 8(*d*) being graphs showing respective characteristic curves of control opening versus pressure differential in relation to different setback amounts.

Before the description of the present invention proceeds, it is to be noted that like parts are designated by like reference numerals throughout the accompanying drawings. In addition, it is also to be noted that, although the deflecting assembly according to the present invention can operate with any type of fluid medium such as gas or liquid, air will be referred to as the fluid medium for the purpose of the description of the present invention.

Referring first to FIGS. 3 and 4, the fluid deflecting assembly according to the present invention comprises a body structure 23 of a substantially loud speaker-like configuration including an upstream control chamber 24 defined by a pair of substantially L-shape cross-section walls and a pair of end walls (only one of which is shown by 23*a*), each of said substantially L-shape walls being constituted by side and front wall members 25 and 27 or 26 and 28 of substantially rectangular configuration. The end walls 23*a* and the substantially L-shape walls are assembled together in spaced relation to each other in such a manner that a nozzle 29 is defined between respective side edges 27*a* and 28*a* of the front wall members 27 and 28 which are opposite to the other side edges respectively joined to the side wall members 25 and 26. It is to be noted that the front wall members 27 and 28 the same size and, in particular, are of equal width so that the nozzle 29 extending between the end walls 23*a* is located intermediately between the respective planes of the side wall members 25 and 26.

The body structure 23 has a supply opening 30 defined at a position opposed to the nozzle 29 and leading into the upstream control chamber 24 so that air under pressure can be supplied into the control chamber 24 and then through the nozzle 29 in a manner which will be described later.

The body structure 23 further includes a pair of guide walls 33 and 34 of substantially identical shape rigidly connected at one side edge to the respective front wall members 27 and 28 and extending outwards from the front wall members 27 and 28, the guide walls 33 and 34 being so curved and so shaped as to diverge outwardly from each other.

In the construction, thus far described, it is to be understood that the body structure 23 is symmetrical with respect to a center axis X—X lying in a plane perpendicular to the plane of the nozzle 29, the side and front wall members 25 and 27 and the guide wall 33 being on one side and of the side and front wall members 26 and 28 and the guide wall 34 being located on the opposite side of the center axis X—X as best shown in FIG. 4.

Operatively accommodated within the upstream control chamber 24 and control plates 31 and 32 of identical size and similar in shape to the side wall members 25 and 26, said control plates 31 and 32 being positioned adjacent to and in parallel relation to the side wall members 25 and 26, respectively. Each of these control plates 31 and 32 is supported by means of, for example, one or more support rods 31*a* and 32*a* movably extending through the associated side wall member 25 or 26, for movement between retracted and projected positions in a direction perpendicular to the associated side wall member 25 or 26 such that the width, shown by Wu, of the control chamber 24 can be varied for the purpose which will be described later. It is to be noted that the width, shown by Ws, of the nozzle 29 is smaller than the width Wu of the control chamber 24. It is also to be noted that each of the side edges 27*a* and 28*a* of the respective front wall members 27 and 28, which define the nozzle 29 therebetween, is so shaped that one of the opposed corners of the side edge 27*a* or 28*a*, which is adjacent to and faces the control chamber 24, is rounded to facilitate a smooth flow of air from the control chamber 24 into an exit passage between the guide walls 33 and 34.

The support rods 31*a* and 32*a* protruding outwards from the corresponding side wall members 25 and 26 may be mechanically coupled to a common drive mechanism through a motion distributor or to separate drive mechanisms so that the control plates 31 and 32 can be either alternately or simultaneously moved between the retracted and projected positions in a direction perpendicular to the side wall members 25 and 26.

The guide walls 33 and 34 have respective slots 35 and 36 extending parallel to the lengthwise direction of the nozzle 29 positional therein at a position adjacent the front end wall members 27 and 28, the function of which will subsequently be described.

The deflecting assembly of the construction shown in and described with reference to FIGS. 3 and 4 operates in the following manner. Assuming that air under pressure from a source (not shown), for example, a fan in an air-conditioner, is supplied into the control chamber 24 through the opening 30 while the control plates 31 and 32 are held at the respective retracted positions as shown in FIG. 4(*a*), a symmetrical stream of air can be established with respect to the center axis X—X. More specifically, the air supplied into the control chamber 24 is, as shown by the arrows, constricted as it passes through the nozzle 29, and subsequently flows as a stream symmetrical with respect to the center axis X—X towards the outside through the passage between the guide walls 33 and 34. It is to be noted that although the air within the control chamber 24, when constricted as it flows through the nozzle 29, tends to flow in a direction towards the center axis X—X as shown by vector representations $a_1$ and $a_2$ which are tangential to the curved flow of both sides of the air stream being established at the nozzle 29, the air flowing through the nozzle 29 is inwardly compressed sufficiently to cancel the vector representations $a_1$ and $a_2$ and, therefore, a symmetrical stream of air can be established as the air emerges from the nozzle towards the exit passage between the guide walls 33 and 34, which air stream in turn flows in a parallel relation to the center axis X—X as shown by the arrows C.

The air stream emerging from the nozzle 29 and flowing into the exit passage between the shaped walls 33 and 34 draws air from the atmosphere through the slots 35 and 36. However, since the distance L of protrusion of each of the guide walls 33 and 34 from the plane of the corresponding front wall member 27 or 28 is relatively small while the angle of divergence of the guide walls 33 and 34 is relatively great, air drawn into the exit passage between the guide walls 33 and 34 through the holes 35 and 36 does not adhere to the guide walls 33 and 34, but is entrained into the air stream emerging from the nozzle 29, thereby flowing in the direction shown by the arrow D.

However, when one of the control plates, for example, the control plate 31, is subsequently moved a certain distance from the retracted position to a position substantially intermediately of the distance between the retracted and projected positions as shown in FIG. 4(*b*), vector representations of flow of both sides of the air stream established at the nozzle 29 are as shown by $a_3$ and $a_4$. In other words, since the distance between the control plate 31 and the nozzle 29 has become smaller than that when the control plate was held at the retracted position as shown in FIG. 4(*a*), the flow of air represented by the vector representation $a_4$ has a greater linearity than the flow of air represented by the vector representation $a_2$ in FIG. 4(*a*) and the angle defined between the vector representation $a_4$ and the center axis X—X becomes smaller than that between the vector representation $a_2$ and the center axis X—X. Consequently, the air stream emerging from the nozzle 29 is forced to deflect towards the guide wall 33, thereby flowing in a direction shown by the arrow E, the angle of the resultant deflection being shown by $\theta_1$ relative to the center axis X—X.

Even in this case, air from the atmosphere can be drawn into the exit passage between the guide walls 33 and 34 through the slots 35 and 36 as the air stream emerges from the nozzle 29, subsequently adjoining the air stream without adhereing to any of the guide walls 33 and 34. Therefore, the air stream, when it emerges from the exit opening on one end of the nozzle 29 remote from the supply opening 30, flows in a direction shown by the arrow F at an angle of deflection shown by $\theta_2$ which is somewhat greater than the angle $\theta_1$.

Figure 1:
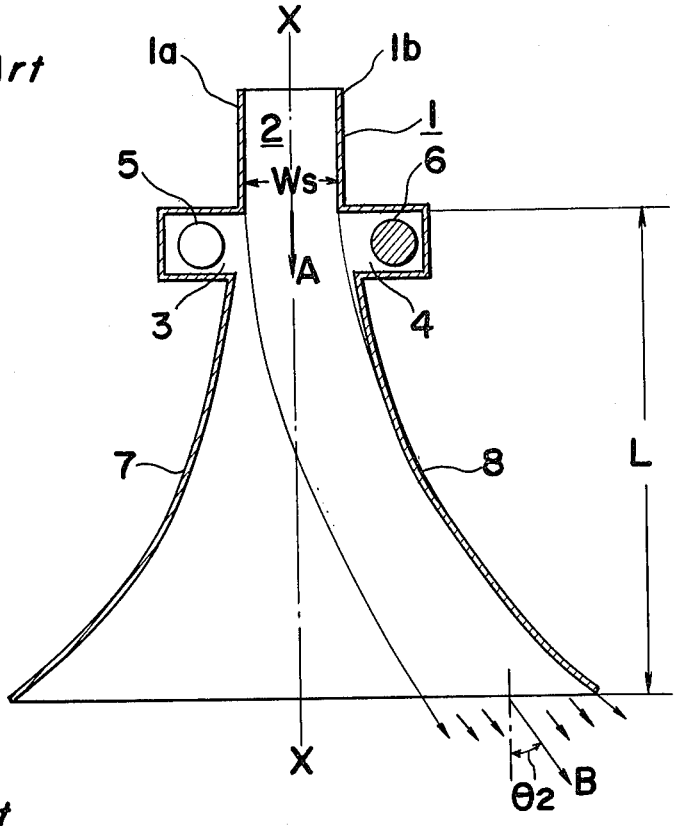
Fig. 1 Prior Art
FIGS. 1 and 2 are schematic horizontal sectional views of two exemplary types of prior art deflecting assemblies, reference to which has been made hereinbefore.
Figure 2:
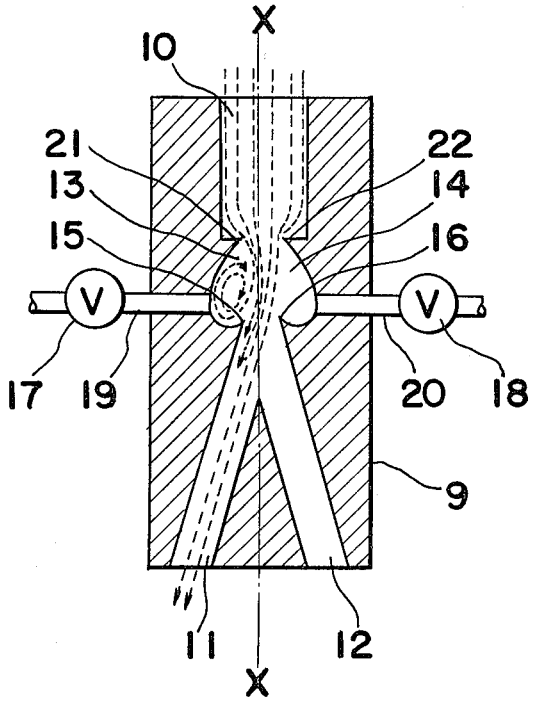
Fig. 2 Prior Art

Finally, when the control plate 31 is further moved to assume the projected position as shown in FIG. 4(*c*), a vector representation of flow of the side of the air stream being established at the nozzle, such as represented by $a_6$, has a greater linearity than the flow of air represented by the vector representation $a_4$ in FIG. 4(*b*) and, therefore, the air stream emerging from the nozzle 29 flows towards the exit opening in a direction, shown by G, at an angle $\theta_3$ of deflection which is greater than the angle $\theta_1$ of deflection in FIG. 4(*b*). Even in this case, air from the atmosphere is drawn into the exit passage between the guide walls 33 and 34 through the slots 35 and 36 as the air stream emerges from the nozzle 29, subsequently adjoining the air stream which in turn flows in a direction, shown by H, while adhering to the guide wall 33 until the air stream separates from the guide wall 33 at the exit opening. When the air stream flows in the direction H while adhering to the guide wall 33, the Coanda effect takes place. The Coanda effect taking place in the manner described above results in an increase of the angle of deflection in an increment of the difference between the angles $\theta_4$ and $\theta_3$. It is to be noted that even though the air stream adheres to the guide wall 33 as hereinbefore described, no self-compensating phenomenon takes place such as occurs in the prior art deflecting assembly as hereinbefore described with reference to FIG. 1.

From the foregoing, it has now become clear that by controlling the mode of flow of the air within the control chamber 24, the air stream emerging from the nozzle 29 can be deflected with the angle of deflection being determined depending upon the position of one or both of the control plates 31 and 32. Moreover, since the Coanda effect enhances deflection of the air stream in a relatively wide angle, the deflecting assembly according to the present invention can be made compact by the employment of the guide walls 33 and 34 protruding a relatively small distance L from the associated front wall members 27 and 28.

It is to be noted that, prior to the control plate 31 being moved to the projected position as shown in FIG. 4(*c*), deflection of the air stream relies on the shape of the nozzle 29 and no Coanda effect takes place. However, during the movement of the control plate 31 from the intermediate position, as shown in FIG. 4(*b*), to the projected position as shown in FIG. 4(*c*), the Coanda effect takes place to enhance the deflection of the air stream. Considering the change from the condition shown in FIG. 4(*b*) to the condition shownm in FIG. 4(*c*), as the angle $\theta_1$ of deflection gradually increases to the angle $\theta_3$, the air stream emerging from the nozzle 29 impinges upon the guide wall 33 and, when the maximum angle $\theta_3$ of deflection has been attained, the angle of impingement of the air stream against the guide wall 33 correspondingly becomes maximum. After the maximum angle $\theta_3$ of deflection has been attained, the air stream emerging from the nozzle 29 starts adhering to the guide wall 33 while flowing in the direction as shown by the arrow H in FIG. 4(*c*) at a maximum available velocity.

It is to be noted that a description similar to that given with reference to FIGS. 4(*a*) to 4(*c*) can be given for the case where the control plate 32, instead of the control plate 31, is moved from the retracted position towards the projected position in which case the air stream is deflected in a direction opposite to that shown in FIGS. 4(*a*) to 4(*c*). The provision of the slots 35 and 36 is advantageous for the removal of hysteresis which may take place when the air stream starts adhering to the guide wall 33 or 34 under the influence of the Coanda effect and also when the air stream, which has adhered to the guide wall 33 or 34 under the influence of the Coanda effect as described above, starts separating from the guide wall 33 or 34 upon deflection thereof. Where such hysteresis does not cause any problem, these slots 35 and 36 may not be necessary.

Referring now to FIGS. 5(*a*) to 5(*c*), the deflecting assembly shown has an auxiliary deflector 37 in the form of a substantially rectangular blade which is pivotally supported between the end walls 23*a* by means of a pivot pin 38 having its opposite ends journalled in the end walls 23*a*, a substantially intermediate portion of said pivot pin 38 being rigidly secured to and extending through the auxiliary deflector 37. This auxiliary deflector 37 is positioned within the control chamber 24 and in alignment with the center axis X—X. This auxiliary deflector 37 may be driven by any suitable drive mechanism (not shown) which may be driven operatively coupled to one of the opposite ends of the pivot pin 38 which extends outwardly from the corresponding end wall 23*a*.

It is to be noted that in the deflecting assembly having the construction shown in FIG. 5, the control plates 31 and 32 and the slots 35 and 36 such as are employed in the embodiment shown in FIG. 4 are not employed.

The operation of the deflecting assembly having the construction shown in FIG. 5(*a*) will now be described with particular reference to FIGS. 5(*b*) and 5(*c*).

Assuming that air under pressure from the source thereof is supplied into the control chamber 24 through the supply opening 30 while the auxiliary deflector 37 is held in a neutral position as shown in FIG. 5(*b*) in which condition the plane of the auxiliary deflector 37 lies in alignment with the center axis X—X and at right angles to the plane of the nozzle 29, the air flowing towards the nozzle 29 is constricted as it passes through the nozzle 29. During the passage of the air through the nozzle 29, the air tends to flow in the directions as represented by vector representations $b_1$ and $b_2$. However, since the air stream emerging from the nozzle 29 is symmetrical with respect to the center axis X—X, the air stream as a whole flows in a direction, shown by the arrow I, parallel to the center axis X—X.

However, when the auxiliary deflector 37 is pivoted to a position such as shown in FIG. 5(*c*) with the plane thereof intersecting at a certain angle with the center axis X—X, a portion of the air flowing between the side edge 27*a* of the front wall member 27 is regulated by the position of the auxiliary deflector 37, thereby flowing outwardly through the nozzle 29 in a direction shown by the arrow K, while another portion of the air flowing between the side edge 28*a* of the front wall member 28 flows outwardly through the nozzle 29 in a direction shown by the arrow J, under the influence of a back pressure developed at the upstream side of the front wall member 28 with respect to the direction of flow of the air. In this way, the air stream emerging from the nozzle 29 is diverted towards the guide wall 33 when the flow of air upstream of the nozzle 29 has been deflected by the auxiliary deflector 37. As the angle of deflection increase to a maximum available value, the Coanda effect takes place at which time the air stream is further deflected until the air stream adheres to the guide wall 33.

A similar description can be given with reference to FIGS. 5(*b*) and (*c*) for the case where the auxiliary deflector 37 is pivoted in the opposite direction in which case the air stream is deflected in the direction opposite to that shown in FIGS. 5(*b*) and (*c*). Moreover, by stopping the auxiliary deflector at any desired position, the angle of deflection of flow of the air stream emerging from the exit opening can be fixed at will.

It is to be noted that in the construction shown in FIGS. 5(*a*)–5(*c*), since the auxiliary deflector 37 even when slightly pivoted deflects the air stream greatly, a relatively small distance of pivotal movement of the auxiliary deflector 37 will be sufficient to cause a relatively wide angle of deflection.

In the embodiment shown in FIGS. 6(*a*) and 6(*b*), instead of the control plates 31 and 32 accommodated within the control chamber 24, such as employed in the embodiment of FIG. 3, a combination of control plate 39 or 40 and control aperture 25*a* or 26*a* is employed for each side wall member 25 and 26. The control plates 39 and 40 are positioned externally of the control chamber 24 and are adapted to close and open the associated control apertures 25*a* and 26*a* respectively defined in the side wall members 25 and 26. Preferably, the control plates 39 and 40 are alternately moved by a drive mechanism (not shown) in such a manner that when one of the control plates, for example, the control plate 39, is held in position to close the control aperture 25*a*, the other control plate 40 is held in position to fully open the control aperture 26*a*.

The deflecting assembly shown in FIGS. 6(*a*) and 6(*b*) is so designed that when the control apertures 25*a* and 26*a* in the side wall members 25 and 26, respectively, are alternately closed one at a time, the air stream emerging from the nozzle 29 can be deflected to one of the guide walls 33 and 34. More specifically, assuming that air under pressure is supplied into the control chamber 24 through the supply opening 30 while both of the control plates 39 and 40 are clear of the associated control apertures 25*a* and 26*a*, the air flowing towards the nozzle 29 is constricted as it passes through the nozzle 29. During the passage of the air through the nozzle 29, the air tends to flow in the directions represented by vector representations $d_1$ and $d_2$. However, since the air stream emerging from the nozzle 29 is symmetrical with respect to the center axis X—X, the air stream as a whole flows in the direction shown by the arrow L in FIG. 6(*a*).

However, when one of the control plates, for example, the control plate 40, is moved towards the control aperture 26*a* to close the latter as shown in FIG. 6(*b*) while the control aperture 25*a* is fully opened, a portion of the air supplied into and flowing in the control chamber 24 flows towards the atmosphere through the control aperture 25*a* and, as a result thereof, the velocity of the air flowing through the nozzle adjacent the side edge 27*a* is such as represented by a vector representation $d_4$ which is more straight-forward than the vector representation $d_2$ shown in FIG. 6(*a*). On the other hand, since the velocity represented by a vector representation $d_3$ does not greatly vary as compared with the vector representation $d_1$ shown in FIG. 6(*a*), the air stream emerging from the nozzle 29 as a whole is deflected in a direction shown by the arrow M. In other words, the flow of air is deflected at an upstream side of the nozzle 29 with respect to the direction of flow towards the exit opening. The air stream so deflected in the direction M causes a Coanda effect, under the influence of which the air stream is further deflected so as to flow while adhering to the guide wall 33.

The foregoing description is equally be applicable to the case where the control aperture 25*a* is closed by the control plate 39 while the control aperture 26*a* is opened. Moreover, by adjusting the opening of both of the control apertures 25*a* and 26*a*, a stable deflecting motion can be imparted to the air stream emerging from the nozzle 29 towards the exit opening of the body structure 23. It is to be noted that even in the construction shown in FIG. 6, the self-compensating phenomenon will not occur.

In any one of the foregoing embodiments shown in FIGS. 3(*a*) to 6(*b*), the nozzle 29 is defined between the respective side edges 27*a* and 28*a* of the front wall members 27 and 28. However, in the embodiment shown in and subsequently described with reference to FIGS. 7(*a*) and 7(*b*), nozzle defining wall members 41 and 42, separate from the front wall members 27 and 28, are employed.

Referring to FIGS. 7(*a*) and 7(*b*), the nozzle defining wall members 41 and 42 project an equal distance into the control chamber 24 from the side wall members 25 and 26, respectively, in parallel relation to and spaced from the front wall members 27 and 28. Free side edges 41*a* and 42*a* of the respective nozzle defining wall members 41 and 42 are spaced from each other to define the nozzle 29 and, therefore, have a shape similar to the side edges 27*a* and 28*a* which have been described with reference to any one of FIGS. 3(*a*) to 6(*b*). It is to be noted that because of the employment of the nozzle defining wall members 41 and 42, the control chamber 24 is substantially divided into a supply compartment 24*a*, positioned on one side of the nozzle 29 adjacent the opening 30, and a control compartment 24*b* positioned between the nozzle defining wall members 41 and 42 and the front wall members 27 and 28. Furthermore, the control compartment 24*b*, when the air stream flows from the nozzle 29 towards the exit opening of the body structure 23, may be considered as being divided by such air stream into two control cavities 43 and 44, the function of which will become clear from the subsequent description.

The side walls 25 and 26 have control apertures 45 and 46 respectively opening into the control cavities 43 and 44, these control apertures 45 and 46 being adapted to be selectively closed and opened by respective control plates 47 and 48 in a similar manner to the control plate 39 and 40 employed in the foregoing embodiment of FIGS. 6(*a*) and 6(*b*).

In the construction shown in FIGS. 7(*a*) and 7(*b*), it is to be noted that each of the nozzle defining wall members 41 and 42 projects into the control chamber 24 a distance greater than the distance of projection of any one of the front wall members 27 and 28 to provide a setback area. This setback area is defined between the plane which passes through the side edge 41*a* or 42*a* at right angles to the plane of the nozzle 29, and the plane which passes through the adjacent side edge of the corresponding front wall member 27 or 28 from which the corresponding guide wall 33 or 34 extends outwardly, the difference between the first and second mentioned planes being defined as a setback distance Se in FIG. 7(*a*).

As is the case with the embodiment shown in FIGS. 6(*a*) and 6(*b*), the control plates 47 and 48 may be connected to any suitable drive mechanism (not shown) so that they can be operated in a manner similar to the control plates 39 and 40 in FIGS. 6(*a*) and 6(*b*).

The operation of the deflecting assembly constructed as shown in FIGS. 7(*a*) and 7(*b*) will now be described.

Assuming that air under pressure is supplied into the supply compartment 24*a* through the supply opening 30 while both of the control plates 47 and 48 are held in position to open the control apertures 45 and 46 as shown in FIG. 7(*a*), the air flowing towards the nozzle 29 is constricted as it passes through the nozzle 29. During the passage of the air through the nozzle 29, the air tends to flow in the directions represented by vector representations $e_1$ and $e_2$. However, since the air stream emerging from the nozzle 29 is symmetrical with respect to the center axis X—X, the air stream as a whole flows in a direction shown by the arrow N which is parallel to the center axis X—X, as shown in FIG. 7(*a*).

However, when one of the control plates, for example, the control plate 47, is moved towards the control aperture 45 to close the latter as shown in FIG. 7(*b*) while the control aperture 46 is fully opened, air from the atmosphere is admitted into the control cavity 44 on the one hand and a negative pressure is developed in the control cavity 43 on the other hand. The smaller the setback distance Se, the greater the negative pressure in the control cavity 43. By the effect of this pressure differential, that is, the difference in pressure between the control cavities 43 and 44, the air stream emerging from the nozzle 29 is deflected towards the guide wall 33 so that it can flow along the guide wall 33. However, since the width Wu of the control chamber, specifically, the supply chamber 24*a*, is greater than the width Ws of the nozzle 29 and the nozzle defining wall members have a relatively small thickness t, the pressure differential developed downstream of the nozzle 29 in the manner as hereinabove described affects the mode of flow of the air at a position upstream of the nozzle 29 and, accordingly, as is the case in all of the embodiments shown in FIGS. 3(*a*) through 6(*b*), deflection of the air stream is initiated at a position upstream of the nozzle 29. It is to be noted that the air stream emerging from the nozzle 29 tends to flow in directions as represented by vector representations $e_3$ and $e_4$, the vector representation $e_4$ being more straight-forward than the vector representation $e_2$ shown in FIG. 7(*a*).

Accordingly, the air stream emerging from the nozzle 29 is deflected an angle of $\theta_5$ from the center axis X—X in a direction shown by P towards the guide wall 33. As this air stream flows along the guide wall 33, the Coanda effect takes place and, as a result thereof, the air stream is further deflected.

It is to be noted that where the air stream is desired to be deflected towards the guide wall 34, that is, in a direction opposite to that shown and described with reference to FIG. 7(*b*), what is required is to close the control aperture 46 on the one hand and to open the control aperture 45 on the other hand.

The inventors of the present invention have conducted a series of experiments by the use of the deflecting assemby having the construction shown in FIGS. 7(*a*) and 7(*b*), wherein the nozzle width Ws was 60 mm., the chamber width Wu was 150 mm. and the distance between the front wall members 27 and 28 and the nozzle defining wall members 41 and 42 was 30 mm. The results of the test are shown in the respective graphs of FIGS. 8(*a*) to 8(*d*).

Referring to FIG. 8(*a*), it will readily been seen that, as the pressure differential, that is, the difference ΔHc between the pressure Hcl within the control cavity 44 and the pressure Hcr within the control cavity 43, increases, the angle $\theta_5$ of deflection increases.

On the other hand, from FIG. 8(*b*), it is clear that as the setback distance Se increases, the pressure differential ΔHc can be increased when the flow from the nozzle 29 is attached to the guide wall 33.

However, when the setback distance was fixed to 2 mm. and as the opening Ac of the control aperture 45 was varied by positioning the control plate 47, the pressure differential ΔHc varied in a manner as shown in the graph of FIG. 8(*c*). On the other hand, when the setback distance was fixed at 3 mm. and as the opening Ac of the control aperture 45 was varied by positioning the control plate 47, the pressure differential ΔHc varied in a manner as shown in the graph of FIG. 8(*d*).

From the graph of FIG. 8(*c*), it can be seen that the pressure differential varies substantially smoothly and, therefore, the air stream emerging from the nozzle can be smoothly deflected in a stable manner. Even when the angle of deflection of flow of the air is fixed at will, the air stream flows steadily in a preselected direction.

In contrast thereto, when the setback distance Se is relatively great, the variation in pressure differential takes place rapidly when the opening Ac becomes about 2 $cm^2$. Although the air stream emerging from the nozzle can hardly be stabilized when the opening Ac is set to be about 2 $cm^2$, a relatively wide angle of deflection can be attained because deflection of the air stream takes place at a position upstream of the nozzle and the Coanda effect occurs in cooperation with either of the guide walls 33 and 34.

It is to be noted that when the setback distance Se is greater than 3 mm., the Coanda effect is enhanced as compared with the deflection of flow of the air taking place at the position upstream of the nozzle and, therefore, variation of the pressure differential takes place rapidly. It has been found that when the setback distance becomes 4 mm., no deflection of flow of the air take place. This is because as the setback distance Se increases, no steady pressure differential can be developed between the control cavities 43 and 44. However, even if the setback distance Se is greater than 4 mm. or more, a favorable deflection of flow of the air can be attained at the position upstream of the nozzle 29 if arrangement is made for air from the atmosphere to be forcibly be supplied into one or the other of the control cavities 43 and 44 through the associated control aperture 45 or 46 to stabilize the pressure differential between the control cavities 43 and 44.

Although the present invention has fully been described by way of example with reference to the accompanying drawings, it is to be noted that various changes and modifications will be apparent to those skilled in the art without departing from the true scope of the present invention. By way of example, in all of the foregoing embodiments, the guide walls 33 and 34 have been described as diverging outwardly from each other. However, it is also possible to employ an arrangement in which one of the guide walls extends straight and the other of the guide walls diverges outwardly from the straight guide wall.

Moreover, the guide walls 33 and 34 need not always be positioned in symmetrical relation to each other with respect to the center axis X—X where the angle of deflection of flow of the air stream in one direction towards one of the guide walls 33 or 34 is desired to be smaller or greater than that in the direction towards the other of the guide walls 34 or 33.

In addition, in any of the embodiments shown in FIGS. 3(*a*) to 7(*b*), where the air stream issuing from the nozzle 29 is desired to be deflected only in one direction relative to the center axis X—X towards one of the guide walls 33 and 34, the other of the guide walls need not always be necessary and, therefore, may be omitted. Alternatively, one or both of the guide walls 33 and 34 may have a straight portion.

Furthermore, although the nozzle defining edges 27*a* and 28*a* and 41*a* and 42*a* have been described as rounded, they need not be limited thereto.

If desired, an automatic drive mechanism for operating the control plates or auxiliary deflector may be employed.

Therefore, these changes and modifications are to be understood as being included within the true scope of the present invention unless they depart therefrom.

What is claimed is:

1. A fluid deflecting assembly which comprises: a nozzle for issuing a main stream of fluid as the fluid passes therethrough, said nozzle having a relatively small thickness in the direction of flow of fluid therethrough as compared with the width thereof in the direction at right angles to the direction of flow of fluid therethrough, said nozzle being so shaped as to constrict the flow of the fluid as the latter passes therethrough, at least one guide wall at a position downstream of said nozzle and having a shape with at least the upstream end curved and substantially diverging outwardly from a plane perpendicular to the plane of said nozzle and opening outwardly in a direction away from said nozzle, said guide wall having the upstream end offset laterally outwardly from the downstream end of said nozzle, and a deflector blade in the form of a substantially elongated plate for controlling the mode of flow of the fluid and positioned with the downstream end thereof at a position upstream of the nozzle with respect to the direction of flow of the main stream of fluid and adjustably supported for deflecting the direction of flow of the main stream at any desired angle towards said guide wall, said guide wall being positioned for controlling the wall attachment of said main stream when the main stream is directed toward said guide wall.

* * * * *